US009340946B2

(12) United States Patent
Wagner

(10) Patent No.: US 9,340,946 B2
(45) Date of Patent: May 17, 2016

(54) PILE CASING

(71) Applicant: Grigorij Wagner, Falkensee (DE)

(72) Inventor: Grigorij Wagner, Falkensee (DE)

( * ) Notice: Subject to any disclaimer, the term of this patent is extended or adjusted under 35 U.S.C. 154(b) by 0 days.

(21) Appl. No.: 14/405,405

(22) PCT Filed: May 20, 2014

(86) PCT No.: PCT/EP2014/060296
§ 371 (c)(1),
(2) Date: Dec. 4, 2014

(87) PCT Pub. No.: WO2015/043776
PCT Pub. Date: Apr. 2, 2015

(65) Prior Publication Data

US 2016/0040384 A1 Feb. 11, 2016

(30) Foreign Application Priority Data

Sep. 26, 2013 (EP) ..... 13186089
Dec. 24, 2013 (WO) ..... PCT/EP2013/077966

(51) Int. Cl.
*E02D 5/24* (2006.01)
*E02D 7/30* (2006.01)
(Continued)

(52) U.S. Cl.
CPC ... *E02D 7/30* (2013.01); *E01B 3/46* (2013.01); *E02D 5/24* (2013.01); *E02D 5/30* (2013.01);
(Continued)

(58) Field of Classification Search
CPC ..... E02D 5/22; E02D 5/24; E02D 5/26; E02D 5/28; E02D 5/285; E02D 5/30
USPC ..... 405/249
See application file for complete search history.

(56) References Cited

U.S. PATENT DOCUMENTS 3,664,139 A * 5/1972 Sexauer ..... E02D 5/32 405/248
3,899,891 A * 8/1975 Kelly ..... E02D 5/58 405/251

(Continued)

FOREIGN PATENT DOCUMENTS

AU 2013206032 A1 6/2013
EP 1114719 A1 7/2001

(Continued)

OTHER PUBLICATIONS

International Search Report (ISR) with regard to PCT/EP2014/060296 as completed by the EPO on Nov. 25, 2014 and mailed on Dec. 2, 2014.

(Continued)

*Primary Examiner* — Frederick L Lagman
(74) *Attorney, Agent, or Firm* — David P. Dickerson

(57) ABSTRACT

A pile casing comprising a hollow that extends through an entire length of the pile casing, wherein the pile casing is manufactured of a first material selected from the group consisting of a polymer material and a composite material comprising a polymer material and at least one of glass fibers, carbon fibers, steel fibers and wood. A pile comprising such a pile casing and a filling that fills the hollow, wherein the filling comprises at least one material selected from the group consisting of sand, gravel, concrete, wood, glass, glass fibers, metal, carbon fibers, steel fibers, basalt fibers, asphalt, asphalt concrete, and a composite comprising at least one material selected from the group consisting of sand, gravel, concrete, wood, glass, glass fibers, metal, carbon fibers, steel fibers, basalt fibers, asphalt and asphalt concrete.

17 Claims, 9 Drawing Sheets

(51) Int. Cl.

| | |
|---|---|
| ***E01B 3/46*** | (2006.01) |
| ***E02D 5/60*** | (2006.01) |
| ***E02D 5/30*** | (2006.01) |
| ***E02D 5/38*** | (2006.01) |
| ***E02D 5/76*** | (2006.01) |
| ***E02D 5/80*** | (2006.01) |
| ***E02D 7/02*** | (2006.01) |
| ***E02D 27/12*** | (2006.01) |

(52) U.S. Cl.
CPC *E02D 5/385* (2013.01); *E02D 5/60* (2013.01); *E02D 5/76* (2013.01); *E02D 5/80* (2013.01); *E02D 7/02* (2013.01); *E02D 27/12* (2013.01)

(56) References Cited

U.S. PATENT DOCUMENTS

| | | | | |
|---|---|---|---|---|
| 4,286,651 | A | 9/1981 | Steiger | |
| 5,320,453 | A * | 6/1994 | Bullivant | E02D 5/50 405/239 |
| 5,650,224 | A * | 7/1997 | March | B29C 47/0016 425/63 |
| 5,800,889 | A * | 9/1998 | Greene | E04G 13/021 428/34.5 |
| 6,042,304 | A | 3/2000 | Manning | |
| 6,062,771 | A * | 5/2000 | Roberts | E02D 5/54 405/232 |
| 6,336,265 | B1 | 1/2002 | Niedermair | |
| 6,409,433 | B1 * | 6/2002 | Hubbell | E02D 5/24 405/231 |
| 6,427,402 | B1 * | 8/2002 | White | E02D 5/08 405/241 |
| 7,517,174 | B2 * | 4/2009 | Wolynski | E02D 5/32 405/232 |
| 2002/0031405 | A1 * | 3/2002 | Queen | E02D 5/30 405/249 |
| 2002/0159843 | A1 * | 10/2002 | Hubbell | E02D 5/24 405/231 |
| 2003/0143037 | A1 * | 7/2003 | Ashton | E02D 5/60 405/250 |
| 2004/0191002 | A1 * | 9/2004 | Nickelson | B09B 1/00 405/257 |
| 2005/0236494 | A1 | 10/2005 | Little et al. | |
| 2008/0035747 | A1 | 2/2008 | Yuan | |
| 2011/0155820 | A1 | 6/2011 | Djerf et al. | |
| 2013/0004239 | A1 * | 1/2013 | Roberts | E02D 5/08 405/107 |
| 2014/0056650 | A1 * | 2/2014 | Reinhall | E02D 5/24 405/232 |

FOREIGN PATENT DOCUMENTS

| | | | |
|---|---|---|---|
| EP | 1905897 | A1 | 4/2008 |
| JP | 2000129602 | A | 5/2000 |
| JP | 2000167966 | A | 6/2000 |
| JP | 2003064602 | A | 3/2003 |
| WO | 9720108 | A1 | 6/1997 |
| WO | 0028144 | A1 | 5/2000 |
| WO | 2010096911 | A1 | 9/2010 |

OTHER PUBLICATIONS

International Search Report (ISR) and Written Opinion of the ISA with regard to PCT/EP2013/077966, to which the present application claims priority, as completed by the EPO on Apr. 14, 2014 and mailed on Apr. 24, 2014.

EPO Communication issued on May 6, 2015 with regard to EP regional phase application EP 13 814 979.4 that evolved from priority application PCT/EP2013/077966.

Luo Guoxi, TC Steel Pile Cofferdam Bite Lock Technology, Fujian Architecture & Construction, pp. 72-75, No. 1, 2012, vol. 163.

* cited by examiner

Fig. 7A
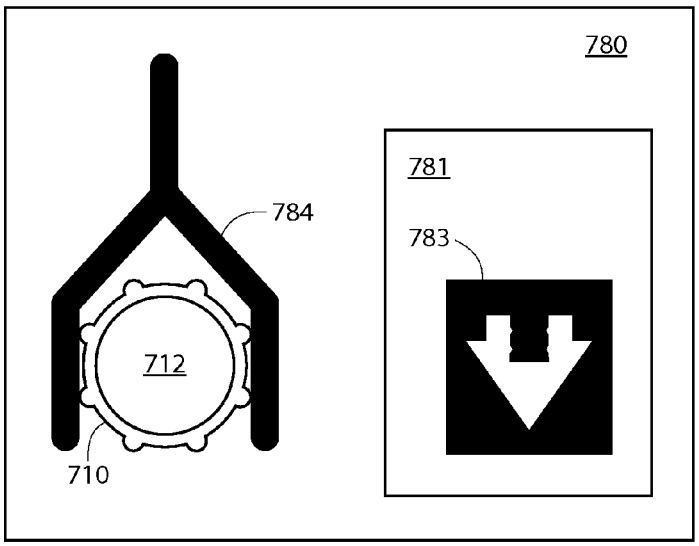
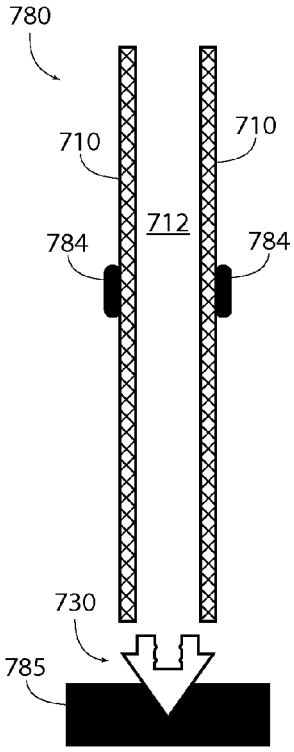
Fig. 7B
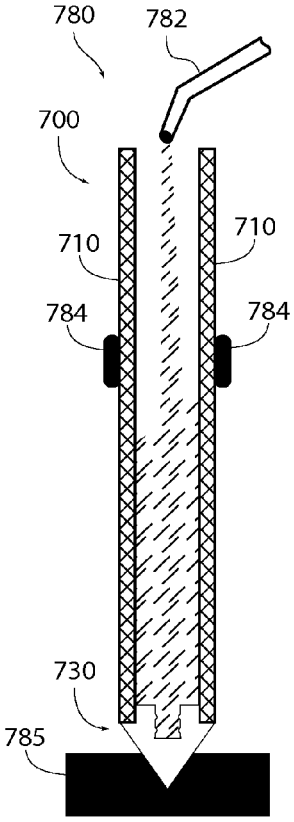
Fig. 7C
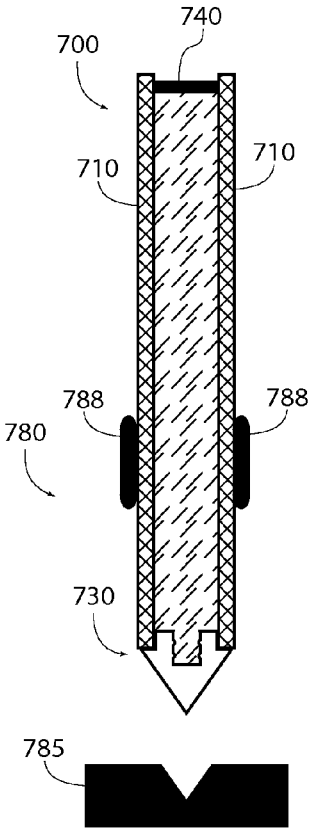
Fig. 7D

PILE CASING

CROSS-REFERENCE TO RELATED APPLICATIONS

This application claims the benefit of European patent application EP 13 186 089.2 entitled "Bahnschwelle" filed with the European Patent Office on Sep. 26, 2013 as well as the benefit of international application No. PCT/EP2013/077966 entitled "STRUCTURAL COMPONENT" filed with the European Patent Office under the PCT on Dec. 24, 2013, the entire disclosures of which are herein expressly incorporated by reference.

BACKGROUND OF THE DISCLOSURE

1. Field of the Disclosure

The present invention relates to a pile casing, to a pile comprising a pile casing, to apparatuses and methods for manufacture thereof and to a use of a pile casing to construct a pile.

2. Description of the Related Art

Piles are known to the prior art for a large variety of uses. Such uses include, inter alia, shoring up the perimeters of construction sites, protecting coastal land, coastal buildings and other coastal/marine structures and providing a stable foundation in loose soil. As such, piles known to the prior art in a large variety of forms including, inter alia, wooden posts, concrete posts and corrugated steel sheets.

The piles known to the prior art offer a wide range of characteristics in terms of strength, durability, recyclability/disposability, ease of manufacture, material cost, etc. There nonetheless remains room for improvement.

The present disclosure expounds upon this background.

SUMMARY OF THE PRESENT DISCLOSURE

The aim of the present summary is to facilitate understanding of the present disclosure. The summary thus presents concepts and features of the present disclosure in a more simplified form and in looser terms than the detailed description below and should not be taken as limiting other portions of the present disclosure.

Loosely speaking, the present disclosure teaches a pile casing that serves as a form for manufacturing a pile. This not only allows a substantial percentage of the pile to be formed of any of a wide variety of materials such as sand or demolition rubble, but also allows manufacture of the pile to be completed at any of a variety of locations. Specifically, manufacture of the pile may be completed off-site (i.e. at a location remote from the location where the pile will ultimately be used, e.g. be driven into the ground), on-site (i.e. at a location proximate to where the pile is actually used), or even in situ (e.g. after the pile casing has been driven into the ground).

The pile casing can be manufactured inexpensively by extrusion using inexpensive materials such as recycled plastic.

The pile casing loosely described above can be embodied in the form of a pile casing comprising a hollow that extends through an entire length of the pile casing, wherein the pile casing is manufactured of a first material selected from the group consisting of a polymer material and a composite material comprising a polymer material and at least one of glass fibers, carbon fibers, steel fibers and wood.

Other objects, advantages and embodiments of the present disclosure will become apparent from the detailed description below, especially when considered in conjunction with the accompanying drawings.

BRIEF DESCRIPTION OF THE DRAWINGS

The Figures show:

FIG. 7A to 7D schematic depictions of another pile manufacturing apparatus in accordance with the present disclosure.

DETAILED DESCRIPTION

Figures 1A, 1B, 1C:
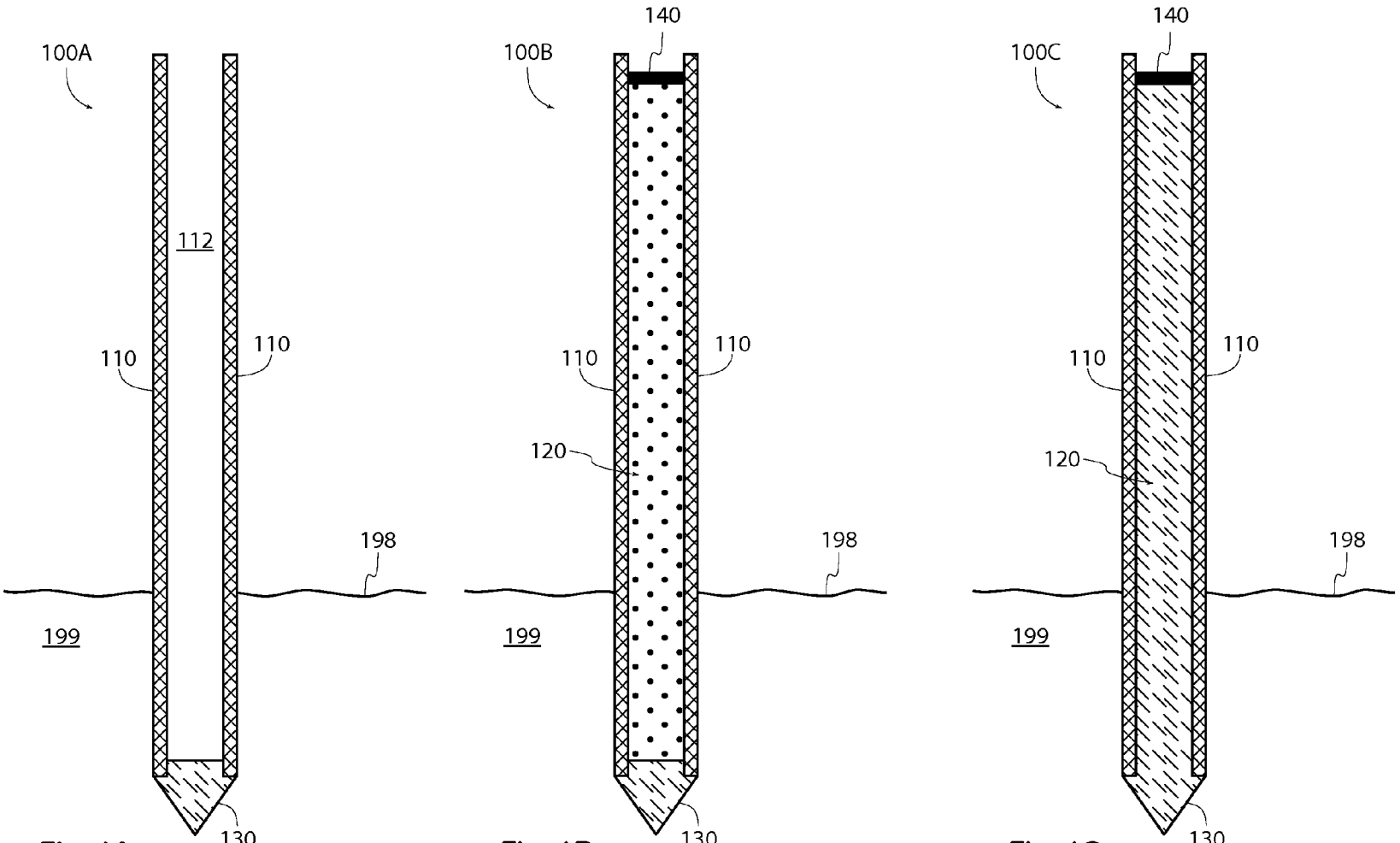
FIG. 1A to 1C a schematic cross-section through an embodiment of a pile in accordance with the present disclosure, respectively.

The various embodiments of the present disclosure and of the claimed invention, in terms of both structure and operation, will be best understood from the following detailed description, especially when considered in conjunction with the accompanying drawings.

Before elucidating the embodiments shown in the Figures, various embodiments of the present disclosure will first be described in general terms.

General Description

As touched upon above, the present disclosure teaches a pile casing.

The pile casing may have a length in the range of 200 to 1500 cm, e.g. in the range of 500 to 1200 cm. The pile casing may have a minimal lateral dimension of at least 5 cm, at least 10 cm, at least 50 cm or at least 100 cm. The pile casing may have a maximal lateral dimension of less than 50 cm, less than 100 cm, less than 200 cm or less than 400 cm. The term "lateral dimension" may be understood as a distance between two parallel lines, each tangent to an exterior surface of the pile casing and perpendicular to a longitudinal axis of the pile casing.

The pile casing may have a (substantially) oval, circular, rectangular or rounded-rectangular cross-sectional outline. The cross-sectional outline may be an outline of any cross-section of the pile casing, e.g. of a cross-section perpendicular to a longitudinal axis of the pile casing. (An elucidation of the term "any" is given in the closing paragraphs of this specification.) The (cross-sectional) outline may be defined by an outer circumference of the pile casing. The cross-sectional outline of the pile casing may be constant along an entire length of the pile casing.

The pile casing may comprise at least one rib provided on an outer and/or inner circumference of the pile casing. (An elucidation of the expression "at least one" is given in the closing paragraphs of this specification.) In other words, the casing may comprise at least one rib provided on an outer/inner surface of the pile casing. The inner surface of the pile casing may be a surface formed at an interface of the hollow and a solid portion of the pile casing. As such, a (substantially) oval, circular, rectangular or rounded-rectangular cross-sectional outline of the pile casing may be interrupted by at least one rib provided on an outer surface of the pile casing. Any of the (individual) ribs may extend in a direction parallel to a longitudinal axis of the pile casing, e.g. may extend along an entirety of a length of the pile casing. The ribs (on an outer surface of the pile casing) may be (substantially) equally distributed along an outer circumference of the pile casing. In other words, a spacing between a respective rib and either adjacent rib (along an outer circumference of the pile casing) may be (substantially) equal for each of the ribs (on an outer surface of the pile casing). Similarly, the ribs (on an inner surface of the pile casing) may be (substantially) equally distributed along an inner circumference of the pile casing. In other words, a spacing between a respective rib and either adjacent rib (along an inner circumference of the pile casing) may be (substantially) equal for each of the ribs (on an inner surface of the pile casing). Any of the ribs may have a lateral dimension, e.g. in a direction perpendicular to a longitudinal axis of the pile casing, in the range of 2% to 20% of a maximal lateral dimension of the pile casing. Any of the ribs may have a lateral dimension in the range of 0.5 to 10 cm, e.g. in the range of 1 to 5 cm. The lateral dimensional may be measured in a direction radial or tangential to an outer/inner surface of the pile casing, e.g. at a location of the respective rib. Any of the ribs may be dimensioned and/or positioned to inhibit a kinking of the pile casing, e.g. during a driving of the pile casing into the ground.

The pile casing may comprise a hollow. In the present disclosure, the term "hollow" may be understood as a volume devoid of (structural) material. The hollow may extend through a(n entire) length of the pile casing, i.e. in a direction parallel to a longitudinal axis of the pile casing. As such, the pile casing may have a tubular form. The hollow may form an opening at one or both longitudinal end(s) of the pile casing, the hollow forming no other openings in the pile casing.

The hollow may have a minimum dimension in a longitudinal direction of the pile casing greater than 50% or greater than 80% of the length of pile casing. The hollow may have a maximum dimension in a longitudinal direction of the pile casing less than 80%, less than 100% or equal to the length of pile casing.

As regards the lateral dimensions of the hollow, the hollow may constitute at least 40%, at least 80% or at least 90% of any lateral dimension of the pile casing. Similarly, the hollow may constitute less than 60%, less than 80%, less than 90% or less than 95% of any lateral dimension of the pile casing. Along any lateral dimension of the pile casing, the hollow may be distanced from an exterior surface of the pile casing by at least 10%, at least 15% or at least 20% of the respective lateral dimension. In other words, a (minimum) thickness of the pile casing as measured along any lateral dimension of the pile casing from an outer circumference of the pile casing to the hollow may be at least 10%, at least 15% or at least 20% of the respective lateral dimension. The pile casing may have a (minimum/maximum) thickness (measured e.g. as above) in the range of 3 to 20 cm, e.g. in the range of 5 to 10 cm.

A cross-sectional outline of the hollow (e.g. as defined by the interface of the hollow and a solid portion of the pile casing at the respective cross-section) may be (substantially) oval, circular, rectangular or rounded-rectangular. (For the sake of legibility, the term "cross-section" is often used in the present specification in lieu of the bulky expression "cross-sectional outline of the hollow.") As touched upon above, a (substantially) oval, circular, rectangular or rounded-rectangular cross-section of the hollow may be interrupted by at least one rib provided on the inner surface of the pile casing. More generally speaking, the cross-section of the hollow/an inner surface of the pile casing may be profiled, i.e. may comprise both concave and convex vertices, e.g. by comprising ribs, engagement structures or other structures, e.g. as described hereinbelow. (A non-profiled surface in the sense of the present disclosure can be visualized as a elastic sheet stretched over a frame that contacts only one side of the elastic sheet, whereas formation of a profiled surface requires contacting both sides of the elastic sheet.)

The cross-sectional outline of the hollow may be a function of longitudinal position within the pile casing. For example, any of an angular orientation (relative to the pile casing), a shape and/or a size of the cross-section may be a function of longitudinal position (of the respective cross-section) within the pile casing. For example, the interface of the pile casing and the hollow may define a helical structure, e.g. a helical structure that twists in a first circumferential direction along a first length of the pile casing and that twists in a second, opposite circumferential direction along a second length of the pile casing. In such a case, the cross-section may be of constant shape and size, an angular orientation of the cross-section (relative to the pile casing) being a function of longitudinal position.

Similarly, as touched upon above, any parameters of the cross-section may be constant over at least part of the length of the hollow or over an entire length of the hollow. For example, all parameters of the cross-section that are not a function of the longitudinal position, e.g. all others of the angular orientation, the shape and/or the size of the cross-section, may (at the same time) be constant (while other parameters of the cross-section vary as a function of longitudinal position within the pile casing). For example, the hollow may have a constant cross-sectional shape, i.e. the cross-section may have a constant shape (and size), along at least a part of the length of the hollow or along an entire length of the hollow. In particular, the hollow may have a constant cross-section, i.e. a cross-section that does not change, along at least a part of the length of the hollow or along an entire length of the hollow.

The pile casing may comprise at least one engagement structure at an interface with the hollow. For example, a cross-section of the pile casing that defines the hollow may define at least one engagement structure. In other words, a cross-section of the hollow may define at least one engagement structure. The (constant) cross-section may be a cross-section in a direction orthogonal to a longitudinal axis of the pile casing and/or of the hollow. Any of the engagement structures may have a shape that, when engaged with a counterpart structure of generally counterpart shape, inhibits motion of the counterpart structure relative to the (respective) engagement structure (in at least one direction). As such, a (substantially) oval, circular, rectangular or rounded-rectangular cross-section of the hollow may be interrupted by at least one engagement structure provided on an inner surface of the pile casing.

As touched upon above, the cross-sectional outline of the hollow may be formed by a (single) closed curve comprising a plurality of concave vertices and a plurality of convex vertices. Since the curve cannot cross its own path, the curve may also be termed a simple closed curve. The curve may comprise at least one line segment and/or curve segments (also known as "arcs"). The interface of the pile casing and the hollow may define a plurality of such cross-sectional outlines, i.e. may define such a cross-sectional outline at any cross-section. A concave vertex may be understood as a vertex at which a portion of the pile casing projects farther into the hollow than adjacent portions of the pile casing, and a convex vertex may be understood as a vertex at which a portion of the hollow projects farther into the pile casing than adjacent portions of the hollow. More specifically, a concave vertex may be understood as a vertex that forms an interior (i.e. facing the hollow) angle greater than 180° with an adjacent point of the curve on one side of the vertex and with another adjacent point of the curve on another, opposite side of the vertex. Similarly, a convex vertex may be understood as a vertex that forms an interior (i.e. facing the hollow) angle less than 180° with an adjacent point of the curve on one side of the vertex and with another adjacent point of the curve on another, opposite side of the vertex. In the context of the present disclosure, a vertex may be a cusp, e.g. as formed at an intersection of two line segments, an intersection of two curve segments or an intersection of a line segment and a curve segment. Similarly, a vertex may be a point on the curve where the first derivative of curvature is zero, a convex vertex being a point where the second derivative of curvature is either positive or negative, and a concave vertex being a point where the second derivative of curvature, by the same measure, is the other of either positive or negative.

The cross-sectional outline of the hollow may comprise at least five, at least ten, at least fifteen or at least twenty concave vertices. Similarly, the cross-sectional outline of the hollow may comprise at least five, at least ten, at least fifteen or at least twenty convex vertices. For example, the cross-sectional outline of the hollow may have the shape of a simple, non-convex polygon having at least five, at least ten, at least fifteen or at least twenty interior angles greater than 180°. The hollow may have a star-shaped cross-section or a cross-section of a sprocket or spur gear.

The concave and convex vertices of the cross-sectional outline of the hollow may be arranged such that a first simple convex polygon can be drawn through a first plurality of the concave/convex vertices that fully encloses a second simple convex polygon drawn through a second plurality of the concave/convex vertices, the first plurality of vertices being entirely distinct from the second plurality of vertices. In other words, the intersection of the set of vertices formed by the first plurality and the set of vertices formed by the second plurality is an empty set. The first plurality may comprise at least five, at least ten, at least fifteen or at least twenty vertices. Similarly, the second plurality may comprise at least five, at least ten, at least fifteen or at least twenty vertices. The first plurality may comprise each of the convex vertices. Similarly, the second plurality may comprise each of the concave vertices. A minimum distance from the first simple convex polygon to the second simple convex polygon may be greater than 1 cm, greater than 2 cm, or greater than 4 cm.

Any of the engagement structures may have an interlocking shape, i.e. a shape that, when engaged with a counterpart structure of a counterpart shape, inhibits disengagement of the counterpart structure from the (respective) engagement structure (in at least one direction). For example, any of the engagement structures may have a shape that, when engaged with a counterpart structure of a counterpart shape, inhibits disengagement of the counterpart structure from the (respective) engagement structure in a radial (inward) direction of the hollow. In the present context, a radial direction of the hollow may be understood as a direction orthogonal to a longitudinal axis of the pile casing and/or of the hollow. In the present context, an inward direction of the hollow may be understood as a direction toward a central region of the hollow, where the term "central region of the hollow" may be understand as a region of the hollow that is distanced from each boundary of the hollow, e.g. by 30% of a diameter of the hollow in the respective direction or by 30% of a minimum (cross-sectional) diameter of the hollow. Such a counterpart structure may be formed by filling the hollow with a material that solidifies to the shape of the hollow such as concrete. The interlocking shape may have a generally T- or mushroom-shaped cross-section. The cross of the "T"/the bulge of the mushroom may be located more closely to a central region of the hollow than the stem of the "T"/the mushroom.

The pile casing may comprise at least one wall/crossbar (hereinafter simply "crossbar") that spans across the hollow, i.e. that (sub)divides the hollow. The crossbar may span across a chord or a diameter of the hollow. The crossbar may extend an entire length of the hollow. The crossbar may have a thickness in the range of 50% to 150% of a thickness of the pile casing as measured from the hollow to an outer surface of the pile casing. The crossbar may have a thickness in the range of 0.5 to 10 cm, e.g. in the range of 1 to 5 cm.

The pile casing may comprise at least one connecting structure formed in/by an outer surface of the pile casing. In other words, (a shape of) an outer surface of the pile casing may define at least one connecting structure. For example, the pile casing may comprise a first connecting structure and a second connecting structure, e.g. a first connecting structure having a first shape and a second connecting structure having a (substantially) counterpart shape. The first connecting structure may be of a shape that matingly engages a shape of the second connecting structure. The second connecting structure may be provided on a side of the pile casing opposite the first connecting structure. The first and second connecting structures may be shaped to allow engagement/disengagement of the first connecting structure of a first pile casing with/from the second connecting structure of a second pile casing in a direction parallel to a longitudinal axis of the first/second pile casing. Similarly, the first and second connecting structures may be shaped to inhibit disengagement of the first connecting structure of a first pile casing from the second connecting structure of a second pile casing in any direction lateral to a longitudinal axis of the first/second pile casing when the first connecting structure of the first pile casing and the second connecting structure of the second pile casing are engaged. The connecting structure may have a generally T- or mushroom-shaped cross-section. For example, the first connecting structure may be structure of a generally T- or mushroom-shaped cross-section that bulges radially outwardly (i.e. away from the hollow) relative to adjacent portions of an outer surface of the pile casing. Similarly, the second connecting structure may be structure of a generally T- or mushroom-shaped cross-section that bulges radially inwardly (i.e. toward the hollow) relative to adjacent portions of an outer surface of the pile casing.

The pile casing may be a unitary structure, i.e. a single-piece structure, or a multi-piece structure, e.g. a two-piece or three-piece structure. Mating faces of the individual pieces of a multi-piece pile casing may comprise at least one alignment structure, e.g. for promoting alignment of the individual pieces when assembled as a pile casing.

The pile casing may comprise/consist of any (combination of) polymer material(s). For example, the pile casing may comprise/consist of a plastic, recycled plastic or thermoplastic material. Similarly, the pile casing may comprise/consist of a composite material comprising a polymer material and at least one of glass fibers, carbon fibers, steel fibers and wood.

As touched upon above, the present disclosure teaches a pile comprising a pile casing in accordance with the present disclosure. The pile may comprise a filling that at least partially fills the hollow of the pile casing. For example, the filling may fill at least 60%, at least 80% or 100% (of the volume) of the hollow. Similarly, the filling may fill not more than 80% or not more than 90% (of the volume) of the hollow. In this regard, an inherent porosity of materials constituting the filling may be understood as "filling" the respective volume of the hollow. Similarly, voids between individual constituent particles (e.g. wood chips, pebbles, shards of glass, chunks of recycled asphalt, etc.) of the filling, e.g. voids arising from suboptimal mating of adjacent particles as a result of their respective shapes, may likewise be understood as "filling" the respective volume of the hollow. As such, the filling may also be designated as a "core" of the pile. The filling may constitute at least 70%, at least 80% or at least 90% (of the volume) of the pile. The filling may exhibit a rigidity that inhibits a bending of the pile in a direction perpendicular to a longitudinal axis of the pile. Similarly, the filling may cooperate with (engagement structures of) the pile casing to inhibit a bending of the pile in a direction perpendicular to a longitudinal axis of the pile. Such rigidity/interaction with the pile casing may be achieved by employment of a solidifying material such as concrete in the filling.

As touched upon above, the pile casing may be a unitary structure, i.e. a single-piece structure, or a multi-piece structure, e.g. a two-piece or three-piece structure. In the case of a multi-piece structure, the filling may act to bond the individual pieces of the pile casing to form a pile casing as described above, e.g. by interacting with engagement structures of the pile casing. For example, the filling may interact with engagement structures of the pile casing by congealing/hardening to a shape that comprises at least one structure of counterpart shape and engaged to an engagement structure of the pile casing. Accordingly, the individual pieces of the pile casing may be held together in the form of the desired pile casing during filling of the filling into the hollow.

The filling may comprise/consist of any (combination of) organic and/or inorganic material(s). For example, the filling may comprise/consist of any (combination of) material(s) selected from the group consisting of sand, gravel, concrete, wood, glass, glass fibers, metal, carbon fibers, steel fibers, basalt fibers, asphalt, plastic, recycled plastic, an elastomer, thermoplastic, a casting resin and asphalt concrete. As such, the filling may comprise/consist of a composite comprising at least one material selected from the group consisting of sand, gravel, concrete, wood, glass, glass fibers, metal, carbon fibers, steel fibers, basalt fibers, asphalt, plastic, recycled plastic, an elastomer, thermoplastic, a casting resin and asphalt concrete. To the respect that the filling may comprise plastic, recycled plastic, an elastomer, thermoplastic and/or a casting resin, the use of such materials may be limited to forming a plug across an entire cross-section of the hollow, e.g. a plug that inhibits a passage of moisture (from one portion of the hollow on one side of the plug) to another portion of the hollow (on an opposite side of the plug). The plug may be provided at/proximate to a longitudinal end of the hollow, e.g. at/within a most distal 5% or at/within a most distal 10% of a length of the hollow. The pile casing and the filling may be of different materials.

The pile may comprise a tip portion. The tip portion may comprise a base portion, e.g. a base portion having a shape that interfaces a shape of a longitudinal end of the pile casing. The base portion may have a cross-sectional outline (substantially) identical to a cross-sectional outline of the longitudinal end of the pile casing. The tip portion may have a (substantially) conical/pyramidal shape. The base portion may form the base of the substantially) conical/pyramidal shape of the tip portion. The tip portion may comprise a tip that forms the tip of the substantially) conical/pyramidal shape of the tip portion. The tip portion may be positioned at a longitudinal end of the pile casing, e.g. with the base portion interfacing the longitudinal end of the pile casing and/or with the tip forming a (longitudinally) most distal portion of the pile. For example, the longitudinal end of the pile casing may matingly receive/be matingly engaged with the base portion. Similarly, the base portion may matingly extend into (the hollow at) the longitudinal end of the pile casing. The base portion may comprise a shoulder portion that mates with the longitudinal end of the pile casing, e.g. that accommodates the thickness of the pile casing at the longitudinal end of the pile casing. The tip may be positioned on a (substantially) central longitudinal axis of the pile casing. The tip portion may be formed separately from the pile casing. Similarly, the tip portion may be of a material that differs from the material of the pile casing. For example, the tip portion may be of concrete, wood, metal, plastic or any combination thereof. The tip portion may be formed integrally with the filling. The tip portion may comprise a hole opposite the tip. The hole may open to the hollow of the pile casing and may accommodate a portion of the filling. The hole may have the shape of a bore and may comprise at least one retaining structure, e.g. a bulge and/or barb, for retaining the tip portion on the pile by establishing cohesion between the tip portion and the filling. The tip portion may comprise a thread or a thread-like structure, e.g. a thread or a thread-like structure that facilitates a screw-like driving of the pile into the ground. The thread or a thread-like structure may be provided on an outer surface of a conically/pyramid shaped portion of the tip portion. The tip portion may be of a structural design and material that withstands a driving of the tip portion (together with the pile casing) into the ground, e.g. by hammering in a direct, nail-like fashion or by screwing in a twisting, screw-like fashion.

The pile casing may be manufactured by extruding a material, e.g. any of the aforementioned materials, through a die having a shape that forms the material into a pile casing as described in the present disclosure.

An extruding apparatus in accordance with the present disclosure may comprise a die, and a drive mechanism that drives a material through the die, wherein the die is shaped to form a pile casing as described in the present disclosure, i.e. a pile casing having features/structures as described in the present disclosure. The drive mechanism may comprise a hydraulic drive mechanism. The extruding apparatus may comprise a transport apparatus for transporting an extruded product, e.g. for transporting an extruded product away from the die. Similarly, the extruding apparatus may comprise a sectioning apparatus for sectioning the extruded product into desired lengths, e.g. into individual piles.

A method of manufacturing a pile casing in accordance with the present disclosure may comprise driving a material through a die to produce an extruded product having a cross-section of a pile casing as described in the present disclosure, i.e. a pile casing having features/structures as described in the present disclosure, and sectioning off lengths of the extruded product. The sectioning may comprise sectioning the extruded product into individual piles having a length as described in the present disclosure. The method may comprise actively or passively changing a state of the extruded product to a (more) solid state, i.e. solidifying the material of the extruded product to a rigid structure. The solidifying may comprise cooling, congealing, drying, vulcanizing and/or curing the material, and may be carried out prior to sectioning of the extruded product. For example, the method may comprise cooling the extruded product/allowing the extruded product to cool prior to sectioning of the extruded product.

Having regard for the detail of the description of the pile casing elsewhere in the present disclosure, the various possible shapes of the die of the extruding apparatus/(extruding) method will not be described in full detail. The person skilled in the art can readily derive the shape of the die from the detailed description of the pile casing, the die having a shape inverse to a cross-section of the pile casing notwithstanding tolerances known in the field of extrusion. For example, the die may have a shape that forms a (unitary) extruded product in the form of a pile casing as detailed above including forming a hollow into the (unitary) extruded product, the hollow extending through a length of the (unitary) extruded structure. The die may have a shape that forms the hollow to have a cross-section of constant shape. Similarly, e.g. for the sake of altering the cross-section of the hollow as a function of longitudinal position, the extruding apparatus may comprise at least one mechanism for altering a shape of the die as a function of time. The die may have a shape that forms the hollow to have a cross-section that defines a plurality of engagement structures. At least one of the engagement structures may have a shape that, when engaged with a counterpart structure of a counterpart shape, inhibits disengagement of the counterpart structure from the engagement structure in a radial direction of the hollow.

As touched upon above, the pile may be manufactured by filling a material, e.g. any of the aforementioned materials, into the hollow of a pile casing as described in the present disclosure. The material filled into the hollow may thus be termed a "filling" and, e.g. for the sake of better readability, the acting of filling may be termed "depositing." The depositing be effected by a filling apparatus, e.g. as described hereinbelow. The filling may be deposited into the hollow in state that allows the filling to conform to the shape of the hollow, e.g. as a liquid, a foam, a melt or slurry. The manufacture of the pile may comprise actively or passively changing a state of the filling to a solid state, i.e. solidifying the filling to the shape of the hollow. The solidifying may comprise cooling, congealing, drying, vulcanizing and/or curing the filling.

More specifically, a method of manufacturing a pile (hereinafter simply "manufacture of the pile") in accordance with the present disclosure may comprise receiving a pile casing as described in the present disclosure and depositing a filling into the hollow of the pile casing. For example, the method may comprise receiving a pile casing comprising a hollow extending through an entire length of the pile casing, and filling a filling into the hollow. As described above, the pile casing may comprise/consist of any (combination of) polymer material(s) or may comprise/consist of a composite material comprising a polymer material and at least one of glass fibers, carbon fibers, steel fibers and wood. As described above, the filling may comprise/consist of any (combination of) organic and/or inorganic material(s). The hollow may have a cross-section that defines a plurality of engagement structures. The method may comprise filling at least 60%, at least 80% or 100% (of the volume) of the hollow with the filling. The method may comprise filling not more than 80% or not more than 90% (of the volume) of the hollow with the filling. As described above, an inherent porosity of the filling and/or void between individual particles thereof may be understood as "filling" the respective volume of the hollow. The depositing of a filling into the hollow may be effected, at least in part, in situ, e.g. subsequent to a driving of the pile casing into the ground. Manufacture of the pile may comprise pumping sand from a location less than 500 m from a pile driven into the ground into the pile as (part of) the filling.

Manufacture of the pile may comprise manufacturing, e.g. as described in the present disclosure, the pile casing that is filled. Furthermore, manufacture of the pile may comprise controlling a motion of a filling nozzle transport mechanism to effect relative motion between the filling nozzle and the pile casing during deposit of the filling into the hollow.

Manufacture of the pile may comprise manufacturing the tip portion, e.g. by casting, molding, milling and/or lathing. Manufacture of the pile may comprise assembling the tip portion onto a longitudinal end of the pile casing. Similarly, manufacture of the pile may comprise manufacturing the tip portion in situ, i.e. on the pile casing.

Manufacture of the pile may comprise positioning the pile casing such that the hollow is adjacent to a cavity of a mold and depositing a (first) material into the cavity (and into a portion of the hollow) to form the tip portion, e.g. via the hollow. Manufacture of the pile may comprise depositing enough of the (first) material into the cavity and the hollow to fill the cavity and a length of at least 2 cm, at least 5 cm, at least 10 cm, at least 20 cm or at least 80% of the length of the hollow (adjacent to the cavity). Similarly, manufacture of the pile may comprise depositing enough of the (first) material into the cavity and the hollow to fill the cavity and a length of not more than 20 cm or not more than 50 cm of the hollow (adjacent to the cavity). The (first) material may be a solid material or a material that solidifies. For example, the (first) material may be/comprise concrete, wood, metal, plastic or any combination thereof and may constitute part of the filling. Manufacture of the pile may comprise removing the pile casing together with the (first) material from the mold.

Manufacture of the pile may comprise depositing enough of a second material to fill at least 80% of the length of the hollow or to fill at least 80%, at least 90% or an entirety of a length of the hollow not filled by the first material. The second material may be a loose material and may constitute part of the filling. The depositing of the second material into the hollow may be effected either prior or subsequent to a driving of the pile casing (together with the tip portion) into the ground.

Manufacture of the pile may comprise depositing a third material into the hollow to form a plug across an entire cross-section of the hollow, e.g. a plug that inhibits a passage of moisture (from one portion of the hollow on one side of the plug) to another portion of the hollow (on an opposite side of the plug). The plug may be provided at/proximate to a longitudinal end of the hollow, e.g. at/proximate to a longitudinal end opposite the tip portion. The plug may be provided at/within a most distal 5% or at/within a most distal 10% of a length of the hollow. The third material may be/comprise plastic, recycled plastic, an elastomer, thermoplastic and/or a casting resin and may constitute part of the filling. Manufacture of the pile may comprise removing the pile casing together with the (first, second and/or third) material from the mold. Similarly, the depositing of the third material into the hollow may be effected subsequent to a depositing of the second material into the hollow. The depositing of the third material into the hollow may be effected either prior or subsequent to a driving of the pile casing (together with the tip portion) into the ground.

A pile manufacturing apparatus in accordance with the present disclosure may comprise at least one filling nozzle. The filling nozzle may be configured and adapted to fill a material into (a portion of) the hollow of the pile casing. As described above, the filling may comprise/consist of any (combination of) organic and/or inorganic material(s). The pile manufacturing apparatus may comprise a control device that controls (a time/amount of) deposit of the filling into the hollow. The control device may control (a time/amount of) deposit of the filling into the hollow such that the filling fills at least 60%, at least 80% or 100% (of the volume) of the hollow. The control device may control (a time/amount of) deposit of the filling into the hollow such that the filling fills not more than 80% or not more than 90% (of the volume) of the hollow. As described above, an inherent porosity of the filling and/or void between individual particles thereof may be understood as "filling" the respective volume of the hollow.

The pile manufacturing apparatus may comprise a mold, e.g. a mold comprising a cavity having the shape of a tip, e.g. a conical or pyramid shape or other counterpart shape of a tip portion as described supra. The mold may be manufactured of metal, concrete, wood, plastic or any combination thereof.

The pile manufacturing apparatus may comprise a tip portion forming apparatus. The tip portion forming apparatus may be/comprise an injection molding apparatus, e.g. an injection molding apparatus comprising a mold with a cavity into which a fluid material is injected to form the tip portion. Similarly, the tip portion forming apparatus may comprise a milling apparatus, e.g. a CNC machine programmed to mill the tip portion from a block of material.

The pile manufacturing apparatus may comprise a placement mechanism.

Placement mechanism may be configured and adapted to receive the pile casing and to place the pile casing such that the hollow is adjacent to a cavity of the mold. The placement mechanism may orient the pile casing such that a longitudinal axis of the hollow is (substantially) vertical. The placement mechanism may align the pile casing over the cavity of the mold such that material filled into the hollow (via the filling nozzle) falls into/in the direction of the cavity. In this respect, the filling nozzle may deposit the filling into the mold (and into at least a portion of the hollow) via the hollow, e.g. as described above in the context of manufacture of the pile.

Alternatively, the placement mechanism may be configured and adapted to receive the pile casing and to assemble the pile casing onto the (prefabricated) tip portion. Similarly, the placement mechanism may be configured and adapted to receive the pile casing and/or the (prefabricated) tip portion and to assemble the (prefabricated) tip portion onto the pile casing.

The control device may control deposit of the filling into the hollow such that a first material, a second material and/or a third material is deposited into the cavity/hollow as described above in the context of manufacture of the pile. For example, the control device may control deposit of the filling into the hollow such that first the first material, then the second material and then the third material are deposited into the cavity/hollow. The pile manufacturing apparatus may comprise separate nozzles for depositing the respective materials into the hollow.

The pile manufacturing apparatus may comprise at least one storage, processing and/or transport device that stores, processes and/or transports the material for filling into the hollow. For example, the pile manufacturing apparatus may comprise a vat, hopper or other container for storing the material. Similarly, the pile manufacturing apparatus may comprise e.g. a heating device for liquefying the material, an aeration/foaming device for foaming the material, a (hydraulic) press for pressurizing the material, a grinding/chopping device for grinding/chopping the material and/or a stirring device for mixing the material. Furthermore, the pile manufacturing apparatus may comprise a screw transport device for transporting the material and/or a pump for pumping the material, e.g. to the nozzle.

The pile manufacturing apparatus may comprise a control device and a filling nozzle transport mechanism, the control device controlling a motion of the filling nozzle transport mechanism to effect relative motion between the filling nozzle and the pile casing during deposit of the filling into the hollow. For example, the nozzle may be moved along a length of the hollow during deposit of the filling into the hollow, e.g. to promote uniform filling of the hollow. Likewise for the sake of promoting uniform filling of the hollow, the pile manufacturing apparatus may orient the pile casing during deposit of the filling into the hollow such that a longitudinal axis of the hollow is aligned (substantially) vertically as touched upon above.

The pile manufacturing apparatus may comprise a removal mechanism, e.g. a removal mechanism that removes the pile casing together with the deposited filling from the mold or from another support structure that supports the constituent elements of the pile during deposit of the filling. Specifically, removal mechanism the may remove the pile casing together with the first, second and/or third material from the mold/support structure.

As touched upon above, the pile casing may be used to construct a pile. In accordance with the present disclosure, use of a pile casing to construct a pile may comprise driving a pile comprising the pile casing and the tip portion into the ground. The pile casing, the pile and/or the tip portion may be as described hereinabove. For example, the use of a pile casing to construct a pile may comprise depositing a filling into the hollow of the pile casing either prior or subsequent to a driving of the pile into the ground. The driving of the pile may comprise hammering the pile into the ground (e.g. in a direct, nail-like fashion) and/or screwing the pile into the ground (e.g. in a twisting, screw-like fashion). The use of a pile casing to construct a pile may comprise pumping sand from a location less than 500 m from a pile driven into the ground into the pile as (part of) the filling.

The use of a pile casing to construct a pile may comprise engaging a (first) connecting structure on an outer surface of a pile casing of a first pile with a (second) connecting structure on an outer surface of a pile casing of a second pile. Engagement of the first and second connecting structures may be effected by a longitudinal motion of the first pile relative to the second pile, e.g. subsequent to a driving of the first pile into the ground and during a driving of the second pile into the ground. The first and second connecting structures may be connecting structures as described hereinabove. For example, the connecting structures may be shaped to inhibit disengagement of the first connecting structure from the second connecting structure in any direction lateral to a longitudinal axis of the first/second pile when the first connecting structure and the second connecting structure are engaged.

The Illustrated Embodiments

The various embodiments of the present disclosure having been described above in general terms, the embodiments shown in the Figures will now be elucidated.

Each of FIGS. 1A to 1C shows a schematic cross-section through a respective embodiment of a pile 100 in accordance with the present disclosure, e.g. as described above. In the illustrated embodiments, the cross-section extends across a lateral dimension of pile 100, i.e. from left to right in the illustration, as well as across a longitudinal dimension of pile 100, i.e. from top to bottom in the illustration.

In FIGS. 1A to 1C, pile 100 is depicted as being driven into the ground 199, reference sign 198 designating the surface 198 of the ground 199. Surface 198 may be underwater, e.g. may be the ocean floor or the bottom of a lake.

In the embodiment illustrated in FIG. 1A, pile 100A comprises a pile casing 110 and a tip portion 130. Pile casing 110 comprises a hollow 112 for receiving a filling 120 (not shown in FIG. 1A). Tip portion 130 is located at a longitudinal end of pile casing 110 and has a conical shape to facilitate a driving of pile 100A into the ground 199. Tip portion 130 extends partially into the hollow to bind tip portion 130 to pile casing 110.

In the embodiment illustrated in FIG. 1B, pile 100B comprises a pile casing 110, a filling 120 that substantially fills hollow 112 (as shown in FIG. 1A), a tip portion 130 and an optional plug 140. Filling 120 may be a filling of loose material such as sand and/or gravel. Pile casing 110 thus serves to retain filling 120 in the general form of pile 100B. Filling 120 (and plug 140) may be deposited into hollow 112 (as shown in FIG. 1A) in situ, i.e. after pile casing 110 has been driven into the ground together with tip portion 130. For example, filling 120 may be deposited into hollow 112 (as shown in FIG. 1A) when pile 100 is in a position as depicted in FIG. 1A. Similarly, filling 120 (and plug 140) may be deposited into hollow 112 (as shown in FIG. 1A) before pile 100B is driven into the ground, e.g. at a location remote from where pile 100B is driven into the ground or at the (construction) site where pile 100B is driven into the ground. Tip portion 130 is located at a longitudinal end of pile casing 110 and has a conical shape to facilitate a driving of pile 100B into the ground 199. Tip portion 130 extends partially into hollow 112 (as shown in FIG. 1A) to bind tip portion 130 to pile casing 110. Plug 140 is located in hollow 112 (as shown in FIG. 1A) proximate to a longitudinal end of pile casing 110 opposite tip portion 130 and may be formed of a polymer material, thus serving to inhibit a passage of moisture from the ambient environment into filling 120.

In the embodiment illustrated in FIG. 1C, pile 100C comprises a pile casing 110, a filling 120 that substantially fills hollow 112 (as shown in FIG. 1A), a tip portion 130 and an optional plug 140. In the illustrated embodiment, filling 120 is formed of the same material as tip portion 130, e.g. of concrete, filling 120 and tip portion 130 forming a unitary structure. Tip portion 130 is located at a longitudinal end of pile casing 110 and has a conical shape to facilitate a driving of pile 100B into the ground 199. Plug 140 is located in hollow 112 (as shown in FIG. 1A) proximate to a longitudinal end of pile casing 110 opposite tip portion 130 and may be formed of a polymer material, thus serving to inhibit a passage of moisture from the ambient environment into filling 120.

FIGS. 2A to 2D schematically depict a method of manufacturing a pile in accordance with the present disclosure, e.g. as described above. Specifically, FIGS. 2A to 2D show four states of the method in temporal sequence.

Figure 2D:
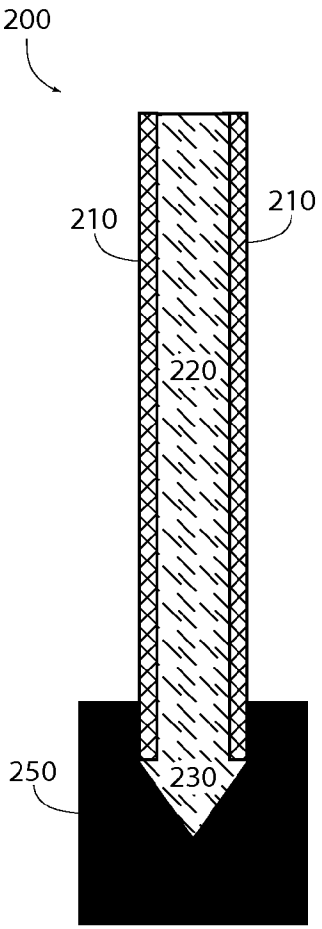
FIG. 2A to 2D a schematic depiction of a method of manufacturing a pile in accordance with the present disclosure.
Figure 2C:
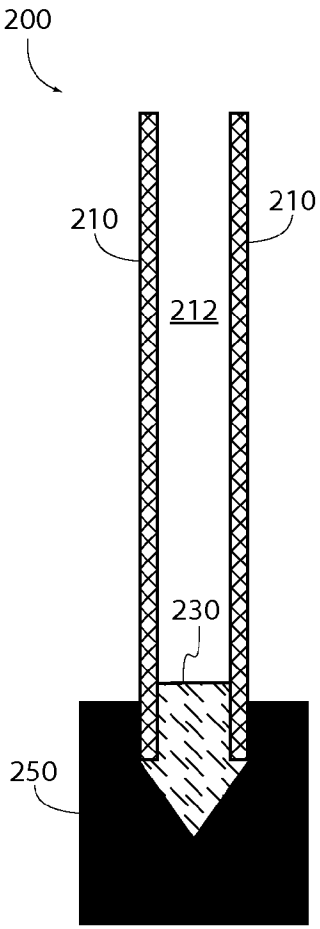
Figure 2B:
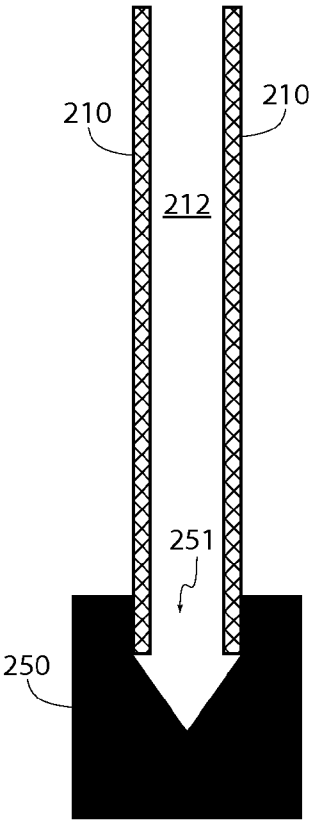
Figure 2A:
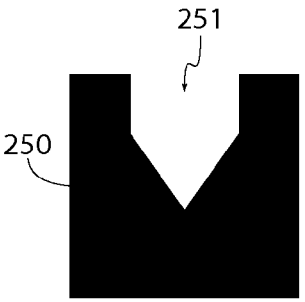

FIG. 2A shows a schematic cross-section through a mold 250 comprising a cavity 251, which mold 250 is used in the method steps shown in FIGS. 2B to 2D to form a tip portion 230 of a pile 200. In the illustrated state, the mold is empty.

FIG. 2B shows a schematic cross-section through mold 250 and a pile casing 210 after pile casing 210 has been positioned such that a hollow 212 through pile casing 212 is adjacent cavity 251 in mold 250. In the illustrated embodiment, pile casing 212 is positioned partially within cavity 251.

FIG. 2C shows a schematic cross-section through mold 250, pile casing 210 and a tip portion 230 after tip portion 230 has been cast by depositing a material into cavity 251 via hollow 212. In the illustrated state, tip portion 230 and pile casing 210 already form a pile 200 that, after congealing of the material forming tip portion 230, can be removed from mold 250 and driven into the ground at a desired location. However, as exemplified by FIG. 2D, FIGS. 2A to 2D show an embodiment in which pile 200 is not removed until hollow 212 has been filled with a material.

FIG. 2D shows a schematic cross-section through mold 250, pile casing 210, tip portion 230 and a filling 220 after filling 220 has been formed by depositing a material into hollow 212. In the illustrated embodiment, filling 220 is formed of the same material as tip portion 230 (e.g. concrete or a concrete composite), filling 220 and tip portion 230 forming a unitary structure. After the material forming filling 220 and tip portion 230 has congealed sufficiently to retain its shape, pile 200 can be removed from mold 250 and driven into the ground at a desired location. As touched upon above, the state shown in FIG. 2D is optional, i.e. is not a requisite state during manufacture of a pile 200 in accordance with the present disclosure.

Each of FIGS. 3A to 3D shows a schematic cross-section through a respective embodiment of a tip portion 330 in accordance with the present disclosure, e.g. as described above. Tip portion 330 may be of a material that withstands a driving of tip portion 330 (together with a pile casing, not shown in FIGS. 3A to 3D) into the ground, e.g. by hammering in a direct, nail-like fashion or by screwing in a twisting, screw-like fashion.

Figure 3A:
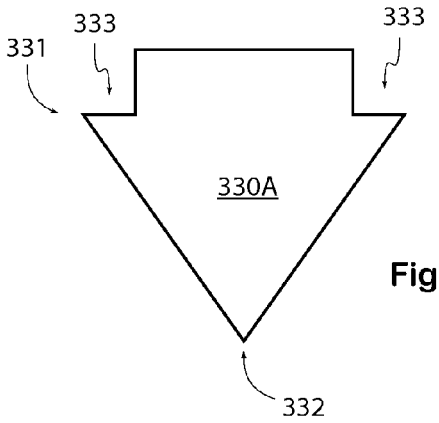
FIG. 3A to 3D a schematic cross-section through an embodiment of a tip portion in accordance with the present disclosure, respectively.

In the embodiment illustrated in FIG. 3A, tip portion 330A has a generally conical shape and comprises a base portion 331 and a tip 332, base portion 331 comprising a shoulder portion 333. The provision of shoulder portion 333 allows base portion 331 to mate with the longitudinal end of a pile casing (not shown in FIG. 3A).

Figure 3B:
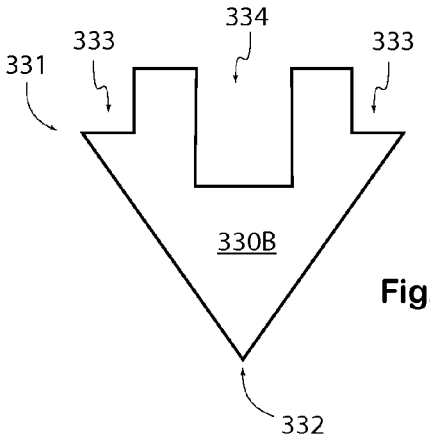

In the embodiment illustrated in FIG. 3B, tip portion 330B has a generally conical shape and comprises a base portion 331 and a tip 332, base portion 331 comprising a shoulder portion 333 as well as a bore-shaped hole 334. Shoulder portion 333 allows base portion 331 to mate with the longitudinal end of a pile casing (not shown in FIG. 3B), while hole 334 provides additional surface area that allows a filling in a hollow of a pile casing (not shown in FIG. 3B) to engage tip portion 330B.

Figure 3C:
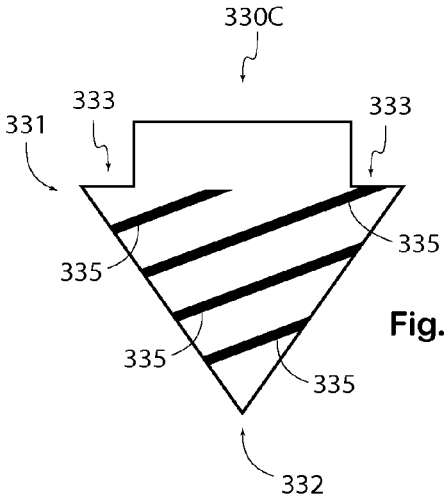

In the embodiment illustrated in FIG. 3C, tip portion 330C has a generally conical shape and comprises a base portion 331, a tip 332 and a thread-like structure 335. Thread-like structure 335 is provided on an outer surface of a conically shaped portion of tip portion 330C and facilitates a screw-like driving of a pile comprising tip portion 330C into the ground. Base portion 331 comprises a shoulder portion 333 that allows base portion 331 to mate with the longitudinal end of a pile casing (not shown in FIG. 3C).

Figure 3D:
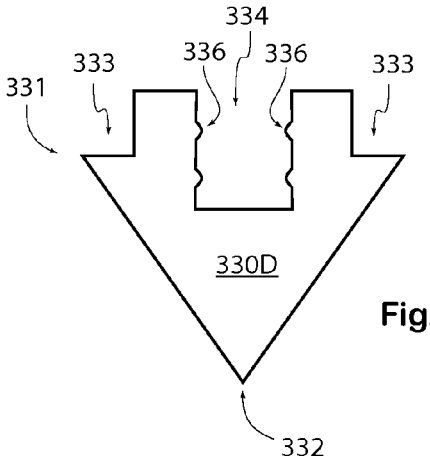

In the embodiment illustrated in FIG. 3D, tip portion 330D has a generally conical shape and comprises a base portion 331 and a tip 332, base portion 331 comprising a shoulder portion 333 as well as a generally bore-shaped hole 334. Shoulder portion 333 allows base portion 331 to mate with the longitudinal end of a pile casing (not shown in FIG. 3B), while hole 334 provides additional surface area that allows a filling in a hollow of a pile casing (not shown in FIG. 3D) to engage tip portion 330D. In the embodiment illustrated in FIG. 3D, hole 334 comprises a plurality of retaining structures 336 in the form of bulges for establishing cohesion between tip portion 330D and the aforementioned filling.

Each of FIGS. 4A to 4H, 4J and 4K (the designation "4I" is omitted on account of its bad legibility in many fonts) shows a schematic cross-section through a respective embodiment of a pile casing 410 in accordance with the present disclosure, e.g. as described above. In the illustrated embodiments, the cross-section is orthogonal to a longitudinal axis of pile casing 410. Although not shown to scale in the Figures, the cross-section of each of the illustrated pile casings 410 is dimensioned so as to allow pile casing 410 to be driven into the ground, e.g. by hammering in a direct, nail-like fashion or by screwing in a twisting, screw-like fashion.

Figure 4A:
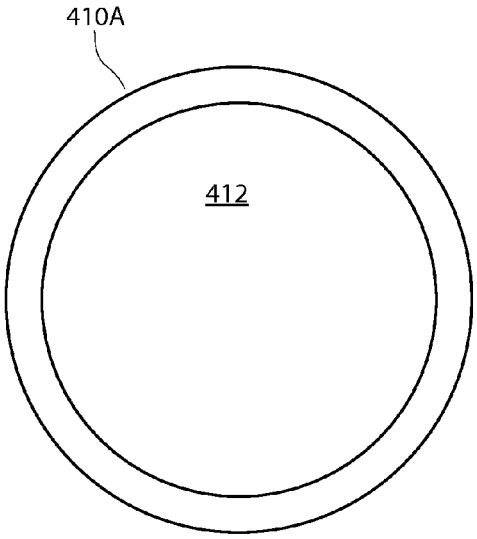
FIG. 4A to 4H a schematic cross-section through an embodiment of a pile casing in accordance with the present disclosure, respectively.

In the embodiment illustrated in FIG. 4A, pile casing 410A has the shape of a circular cylinder, i.e. has an annular cross-section that circumscribes a hollow 412.

Figure 4B:
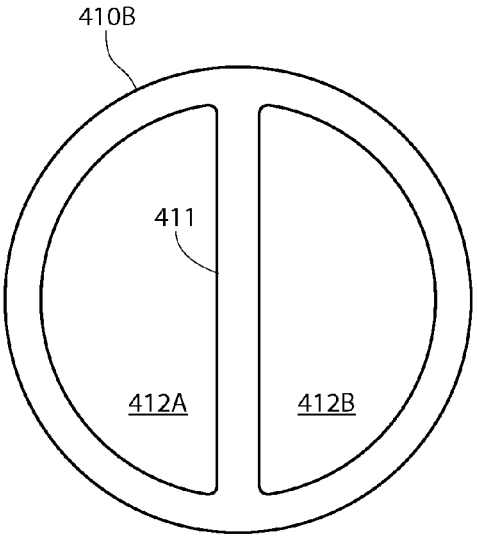

In the embodiment illustrated in FIG. 4B, pile casing 410B has the general shape of a circular cylinder, i.e. has a generally annular cross-section that circumscribes a hollow 412. Pile casing 410B comprises a crossbar 411 that spans a diameter of pile casing 410B, thus dividing hollow 412 into two chambers, i.e. into two hollows 412A and 412B.

Figure 4C:
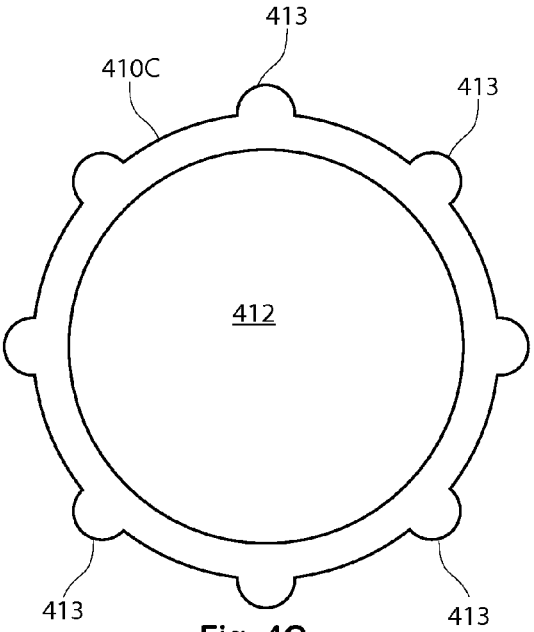

In the embodiment illustrated in FIG. 4C, pile casing 410C has the general shape of a circular cylinder, i.e. has a generally annular cross-section that circumscribes a hollow 412. Pile casing 410C comprises a plurality of ribs 413 distributed on an outer circumference of pile casing 410C. For the sake of legibility, only four of ribs 413 are designated by reference signs in the illustration. Each of ribs 413 extends along an entire length of pile casing 410C parallel to a longitudinal axis of pile casing 410C. An inner circumference of pile casing 410C that circumscribes hollow 412 is circular.

Figure 4D:
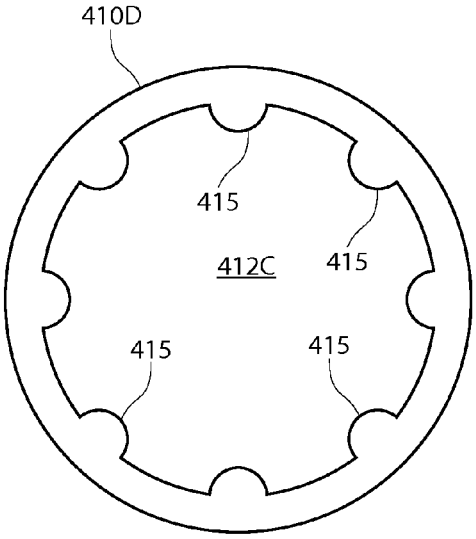

In the embodiment illustrated in FIG. 4D, pile casing 410D has the general shape of a circular cylinder, i.e. has a generally annular cross-section that circumscribes a hollow 412C. Pile casing 410C comprises a plurality of ribs 415 distributed on an inner circumference of pile casing 410D. For the sake of legibility, only four of ribs 415 are designated by reference signs in the illustration. Each of ribs 415 extends along an entire length of pile casing 410D parallel to a longitudinal axis of pile casing 410D. An outer circumference of pile casing 410D is circular.

Figure 4E:
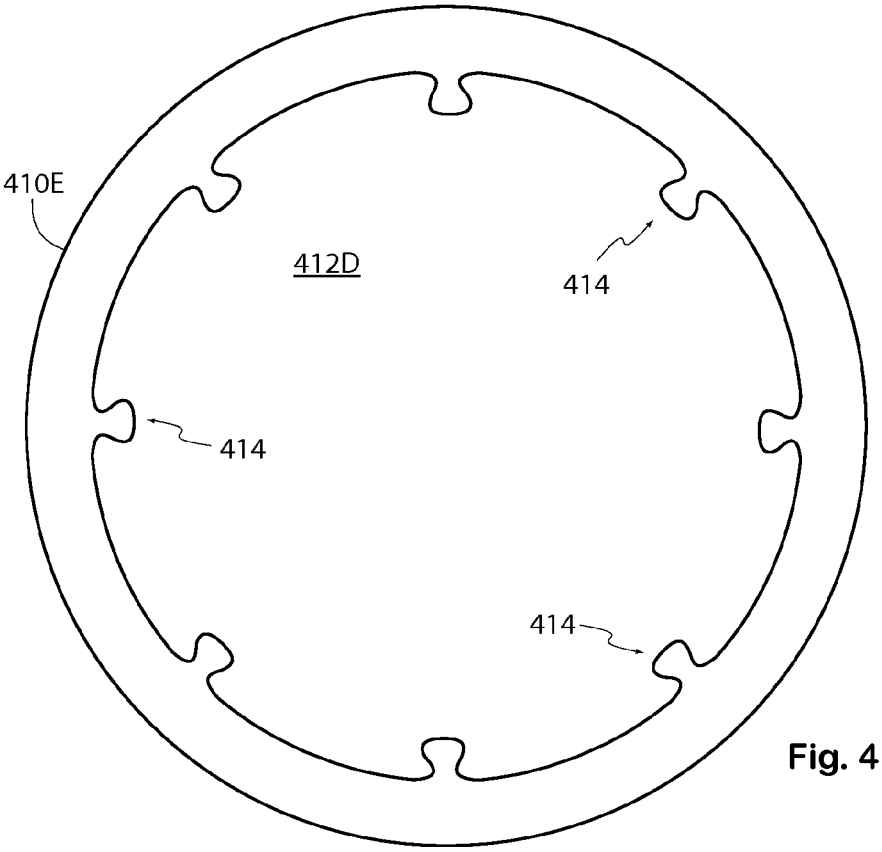

In the embodiment illustrated in FIG. 4E, pile casing 410E has the general shape of a circular cylinder, i.e. has a generally annular cross-section that circumscribes a hollow 412D. Pile casing 410E comprises a plurality of engagement structures 414 distributed on an inner circumference of pile casing 410E. For the sake of legibility, only three of engagement structures 414 are designated by reference signs in the illustration. Each of engagement structures 414 has a generally mushroom-shaped cross-section and extends along an entire length of pile casing 410E parallel to a longitudinal axis of pile casing 410E. An outer circumference of pile casing 410E is circular.

Figure 4F:
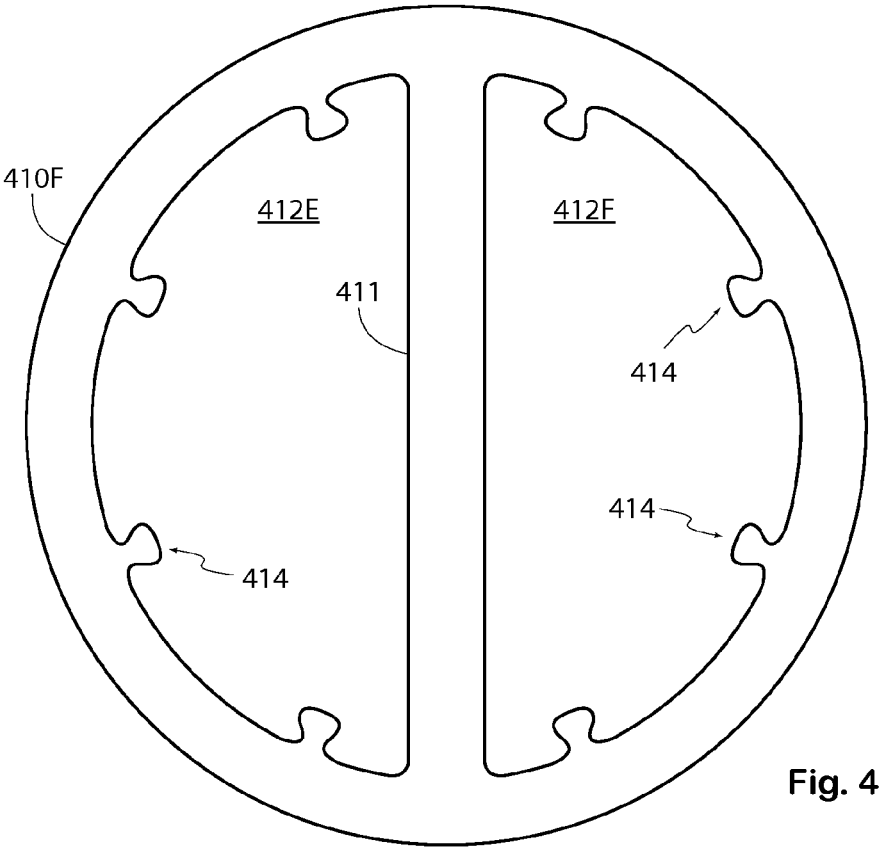

In the embodiment illustrated in FIG. 4F, pile casing 410F has the general shape of a circular cylinder, i.e. has a generally annular cross-section that circumscribes a hollow 412. Pile casing 410F comprises a crossbar 411 that spans a diameter of pile casing 410F, thus dividing hollow 412 into two chambers, i.e. into two hollows 412E and 412F. Pile casing 410F comprises a plurality of engagement structures 414 distributed on an inner circumference of pile casing 410F. For the sake of legibility, only three of engagement structures 414 are designated by reference signs in the illustration. Each of engagement structures 414 has a generally mushroom-shaped cross-section and extends along an entire length of pile casing 410F parallel to a longitudinal axis of pile casing 410F. An outer circumference of pile casing 410F is circular.

Figure 4G:
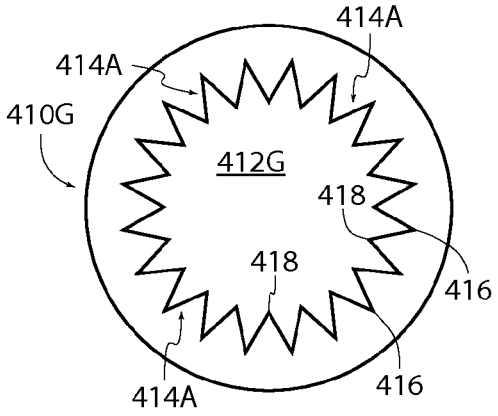

In the embodiment illustrated in FIG. 4G, pile casing 410G comprises a star-shaped hollow 412G that extends in a longitudinal direction of pile casing 410G, i.e. into and out of the plane of the page. The cross-sectional outline of hollow 412G comprises both a plurality of convex vertices 416 as well as a plurality of concave vertices 418 and defines a plurality of engagement structures 414A. For the sake of legibility, only a few of the numerous concave/convex vertices and only three of the numerous engagement structures are designated by reference signs in the illustration.

Figure 4H:
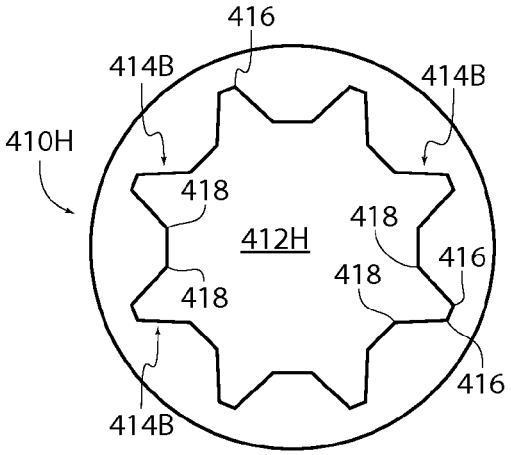

In the embodiment illustrated in FIG. 4H, pile casing 410H comprises a sprocket-shaped hollow 412H that extends in a longitudinal direction of pile casing 410H, i.e. into and out of the plane of the page. The cross-sectional outline of hollow 412H comprises both a plurality of convex vertices 416 as well as a plurality of concave vertices 418 and defines a plurality of engagement structures 414B. For the sake of legibility, only a few of the numerous concave/convex vertices and only three of the numerous engagement structures are designated by reference signs in the illustration.

Figure 4J:
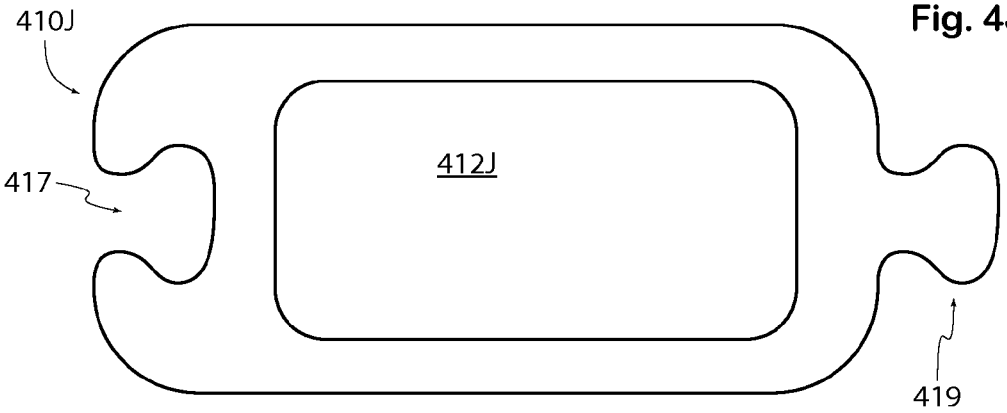
FIGS. 4J and 4K a schematic cross-section through an embodiment of a pile casing in accordance with the present disclosure, respectively.

In the embodiment illustrated in FIG. 4J, pile casing 410J has the general shape of a rectangular cylinder, i.e. has a generally rectangular cross-section that circumscribes a hollow 412J. Pile casing 410J comprises a first connecting structure 417 and a (counterpart) second connecting structure 419 defined by an outer surface of pile casing 410J. Each of first connecting structure 417 and second connecting structure 419 extends along an entire length of pile casing 410J parallel to a longitudinal axis of pile casing 410J. Each of first connecting structure 417 and second connecting structure 419 has a generally mushroom-shaped cross-section, first connecting structure 417 being defined by an indentation in the outer surface of pile casing 410J, second connecting structure 419 being defined by a protrusion of the outer surface of pile casing 410J.

Figure 4K:
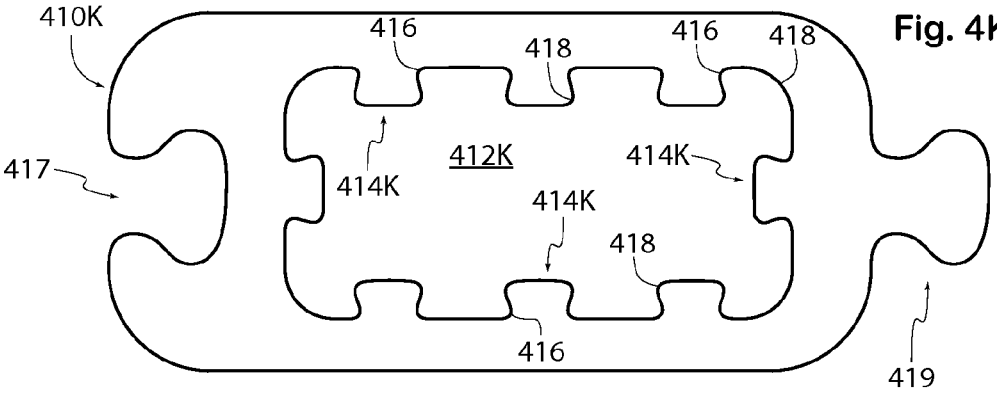

In the embodiment illustrated in FIG. 4K, pile casing 410K has the general shape of a rectangular cylinder, i.e. has a generally rectangular cross-section that circumscribes a hollow 412K. Pile casing 410K comprises a first connecting structure 417 and a (counterpart) second connecting structure 419 defined by an outer surface of pile casing 410K. Each of first connecting structure 417 and second connecting structure 419 extends along an entire length of pile casing 410K parallel to a longitudinal axis of pile casing 410K. Each of first connecting structure 417 and second connecting structure 419 has a generally mushroom-shaped cross-section, first connecting structure 417 being defined by an indentation in the outer surface of pile casing 410K, second connecting structure 419 being defined by a protrusion of the outer surface of pile casing 410K. Pile casing 410K comprises a plurality of engagement structures 414K distributed on an inner circumference of pile casing 410K. For the sake of legibility, only three of engagement structures 414K are designated by reference signs in the illustration. Each of engagement structures 414K extends along an entire length of pile casing 410K parallel to a longitudinal axis of pile casing 410K.

Figure 5A:
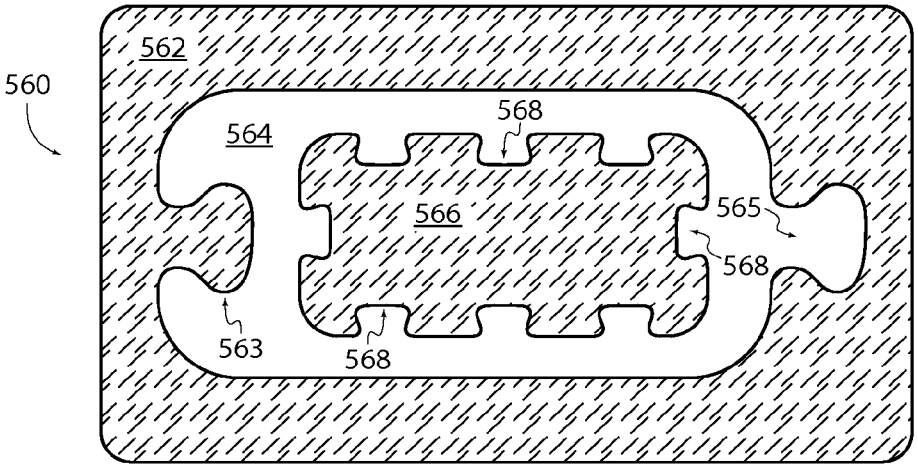
FIG. 5A a schematic depiction of a die in accordance with the present disclosure.

FIG. 5A shows a schematic depiction of a die 560 in accordance with the present disclosure, e.g. as described above. Die 560 may be used in an extruding apparatus, in particular for manufacturing a pile casing in accordance with the present disclosure.

In the illustrated embodiment, die 560 comprises a first die portion 562 and a second die portion 566 that define an opening 564 through which a material may be pressed to form an extruded product having a cross-section of substantially a shape of opening 564. In the illustrated embodiment, opening 564 has a cross-section that defines a first connecting structure 563, a second (counterpart) connecting structure 565 as well as a plurality of engagement structures 568. For the sake of legibility, only three of engagement structures 568 are designated by reference signs in the illustration.

Figure 5B:
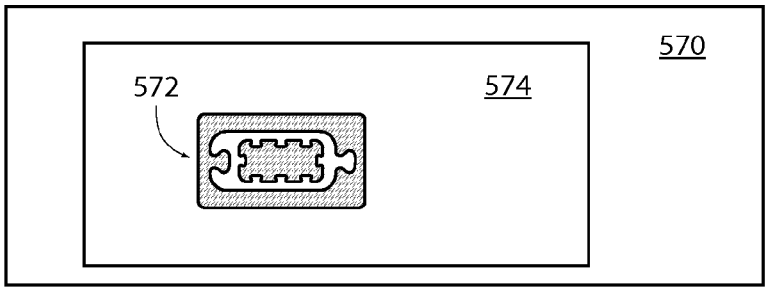
FIG. 5B a schematic depiction of an extruding apparatus in accordance with the present disclosure.

FIG. 5B shows a schematic depiction of an extruding apparatus 570 in accordance with the present disclosure, e.g. as described above. Extruding apparatus 570 may be used for manufacturing a pile casing in accordance with the present disclosure, e.g. as described above.

In the illustrated embodiment, extruding apparatus 570 comprises a die 572, e.g. a die as shown in FIG. 5A, and a drive mechanism 574 that drives a material through an opening 564 in die 572, e.g. by means of a screw mechanism. Extruding apparatus 570 may heat the material to a molten state and drive the material through die 572 in its molten state. Extruding apparatus 570 may drive the material through die 572 at a pressure on the order of tens of MPa.

After being extruded through opening 564 in die 572, the material may be subjected to active or passive processing that changes a state of the extruded product to a (more) solid state, i.e. solidifies the material of the extruded product to a rigid structure, before being sectioned into desired lengths. As touched upon above, the solidifying may comprise cooling, congealing, drying, vulcanizing and/or curing the material. For example, the method may comprise cooling the extruded product/allowing the extruded product to cool prior to sectioning of the extruded product.

Figure 6A:
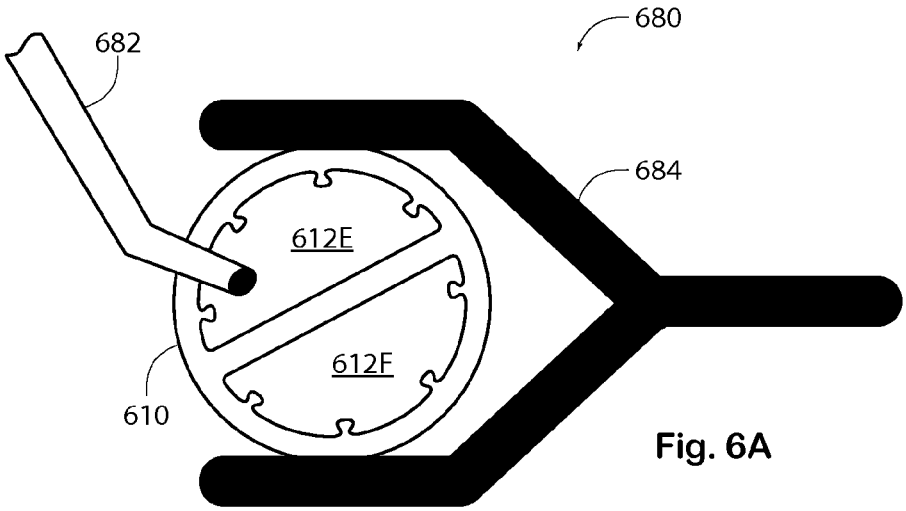
FIG. 6A to 6C schematic depictions of a pile manufacturing apparatus in accordance with the present disclosure.
Figure 6B:
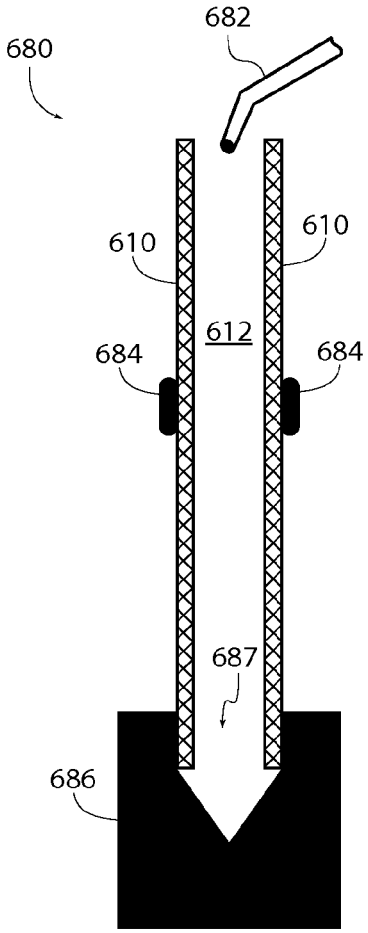
Figure 6C:
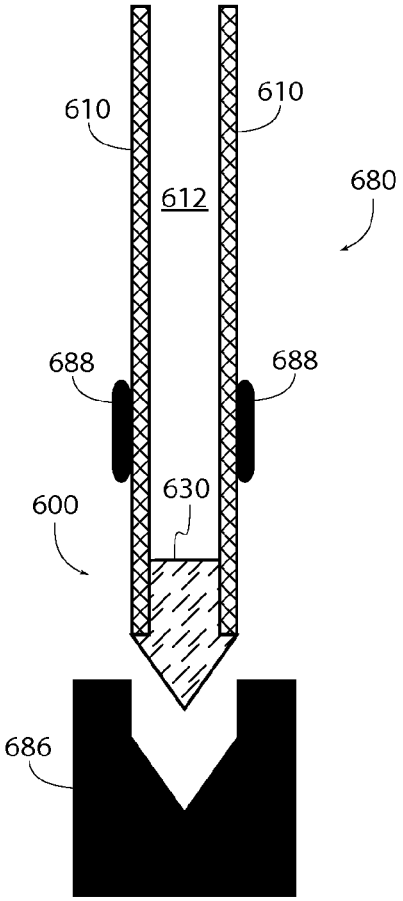

FIGS. 6A to 6C show schematic depictions of a pile manufacturing apparatus 680 in accordance with the present disclosure. In the illustrated embodiment, pile manufacturing apparatus 680 comprises a filling nozzle 682, a mold 686 (shown in FIG. 6B), a placement mechanism 684 and a removal mechanism 688 (shown in FIG. 6C).

FIG. 6A shows placement mechanism 684 in the form of a gripper gripping a pile casing 610 of a shape as shown in FIG. 4F, i.e. with two hollows 612E and 612F. Placement mechanism 684 receives pile casing 610 and positions pile casing 610 such that filling nozzle 682 can fill a material into hollow 612.

Pile manufacturing apparatus 680 may control a motion of filling nozzle 682 during filling of the material into hollow 612. For example, filling nozzle 682 may be moved along a length of the hollow 612 during filling of the material into hollow 612, e.g. to promote uniform filling of hollow 612 with the material. Similarly, filling nozzle 682 may be moved such that material is deposited into both hollow 612E and hollow 612F.

FIG. 6B shows a schematic depiction of pile manufacturing apparatus 680 of FIG. 6A. In FIG. 6B, placement mechanism 684 has placed pile casing 610 into cavity 687 in mold 686 such that a longitudinal axis of hollow 612 is aligned (substantially) vertically over cavity 687 and such that material filled into hollow 612 (via filling nozzle 682) falls into/in the direction of cavity 687.

FIG. 6C shows another schematic depiction of pile manufacturing apparatus 680 of FIG. 6A. In FIG. 6C, a tip portion 630 has been formed by filling material into cavity 687 via hollow 612. Removal mechanism 688 has removed pile casing 610 from cavity 687 together with tip portion 630, pile casing 610 and tip portion 630 together constituting a pile 600 with a hollow 612 that can be filled with a material either before or after pile 600 is driven into the ground.

FIGS. 7A to 7D show schematic depictions of another pile manufacturing apparatus 780 in accordance with the present disclosure. In the illustrated embodiment, pile manufacturing apparatus 780 comprises a tip portion forming apparatus 781, a filling nozzle 782, a support 785 (shown in FIG. 7B), a placement mechanism 784 and a removal mechanism 788 (shown in FIG. 7D).

As schematically depicted in FIG. 7A, tip portion forming apparatus 781 can be an injection molding apparatus comprising a mold 783 with a cavity into which material is injected to form a tip portion 730 (shown in FIG. 7B). Tip portion 730 is then transferred to support 785 (shown in FIG. 7B) for assembly with a pile casing 710.

As schematically depicted in FIGS. 7A, 7B and 7C, placement mechanism 784, here in the form of a gripper, receives pile casing 710 and assembles pile casing 710 onto tip portion 730 supported by support 785. Pile manufacturing apparatus 780 then fills material into a hollow 712 of pile casing 710 via nozzle 782 and forms a plug 740 (shown in FIG. 7D) by depositing another material into hollow 712 via nozzle 782.

As schematically depicted in FIG. 7D, removal mechanism 788 then removes the completed pile 700 from support 785.

In the present disclosure, the verb "may" is used to designate optionality/noncompulsoriness. In other words, something that "may" can, but need not. In the present disclosure, the verb "comprise" may be understood in the sense of including. Accordingly, the verb "comprise" does not exclude the presence of other elements/actions. In the present disclosure, relational terms such as "first," "second," "top," "bottom" and the like may be used solely to distinguish one entity or action from another entity or action without necessarily requiring or implying any actual such relationship or order between such entities or actions.

In the present disclosure, the term "any" may be understood as designating any number of the respective elements, e.g. as designating one, at least one, at least two, each or all of the respective elements. Similarly, the term "any" may be understood as designating any collection(s) of the respective elements, e.g. as designating one or more collections of the respective elements, a collection comprising one, at least one, at least two, each or all of the respective elements. The respective collections need not comprise the same number of elements.

In the present disclosure, the expression "at least one" is used to designate any (integer) number or range of (integer) numbers (that is technically reasonable in the given context). As such, the expression "at least one" may, inter alia, be understood as one, two, three, four, five, ten, fifteen, twenty or one hundred. Similarly, the expression "at least one" may, inter alia, be understood as "one or more," "two or more" or "five or more."

In the present disclosure, expressions in parentheses may be understood as being optional. As used in the present disclosure, quotation marks may emphasize that the expression in quotation marks may also be understood in a figurative sense. As used in the present disclosure, quotation marks may identify a particular expression under discussion.

In the present disclosure, many features are described as being optional, e.g. through the use of the verb "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of the invention, even those disclosed solely in combination with other features of the invention, may be combined in any configuration excepting those readily apparent to the person skilled in the art as nonsensical. Likewise, use of the singular and plural is solely for the sake of illustration and is not to be interpreted as limiting. Except where the contrary is explicitly noted, the plural may be replaced by the singular and vice-versa.

The invention claimed is:

1. A pile casing comprising:

a hollow that extends through an entire length of said pile casing, wherein said pile casing is manufactured of a first material selected from the group consisting of a polymer material and a composite material comprising a polymer material and at least one of glass fibers, carbon fibers, steel fibers and wood, and a cross-section of said hollow defines a plurality of engagement structures in said hollow, at least one of said engagement structures extending along an entire length of said hollow and having a shape that, when engaged with a counterpart structure of a counterpart shape, inhibits disengagement of said counterpart structure from said engagement structure in a radial direction of said hollow.

2. The pile casing of claim 1, wherein:

said hollow has a cross-section of constant shape, said cross-section defining a profiled inner surface, and said pile casing has a minimum thickness as measured between an exterior surface of said pile casing and said profiled inner surface of at least 3 cm.

3. The pile casing of claim 1, comprising:

a first connecting structure defined by an outer surface of said pile casing, and a second connecting structure defined by an outer surface of said pile casing opposite said first connecting structure, wherein said first connecting structure is of a shape that matingly engages a shape of said second connecting structure.

4. The pile casing of claim 1, wherein:

said radial direction is an inward direction orthogonal to a longitudinal axis of said hollow.

5. The pile casing of claim 1, wherein:

said at least one of said engagement structures has a T-shaped cross-section or a mushroom-shaped cross-section.

6. The pile casing of claim 1, wherein:

said pile casing has a substantially rounded-rectangular cross-sectional outline.

7. A pile comprising:

a pile casing comprising a hollow that extends through an entire length of said pile casing; and a filling that fills said hollow, wherein said pile casing is manufactured of a first material selected from the group consisting of a polymer material and a composite material comprising a polymer material and at least one of glass fibers, carbon fibers, steel fibers and wood, said filling comprises at least one material selected from the group consisting of sand, gravel, concrete, wood, glass, glass fibers, metal, carbon fibers, steel fibers, basalt fibers, asphalt, asphalt concrete, and a composite comprising at least one material selected from the group consisting of sand, gravel, concrete, wood, glass, glass fibers, metal, carbon fibers, steel fibers, basalt fibers, asphalt and asphalt concrete, and a cross-section of said hollow defines a plurality of engagement structures in said hollow, at least one of said engagement structures extending along an entire length of said hollow and having a shape that, when engaged with a counterpart structure of a counterpart shape, inhibits disengagement of said counterpart structure from said engagement structure in a radial direction of said hollow.

8. The pile of claim 7, wherein:

said hollow has a cross-section of constant shape, said cross-section defining a profiled inner surface, and said pile casing has a minimum thickness as measured between an exterior surface of said pile casing and said profiled inner surface of at least 3 cm.

9. The pile of claim 7, wherein:

said radial direction is an inward direction orthogonal to a longitudinal axis of said hollow.

10. The pile of claim 7, wherein:

said at least one of said engagement structures has a T-shaped cross-section or a mushroom-shaped cross-section.

11. The pile of claim 7, wherein:

said pile casing has a substantially rounded-rectangular cross-sectional outline.

12. A method of manufacturing a pile, comprising:

receiving a pile casing comprising a hollow that extends through an entire length of said pile casing, and filling said hollow with a filling, wherein said pile casing is manufactured of a first material selected from the group consisting of a polymer material and a composite material comprising a polymer material and at least one of glass fibers, carbon fibers, steel fibers and wood, said filling comprises at least one material selected from the group consisting of sand, gravel, concrete, wood, glass, glass fibers, metal, carbon fibers, steel fibers, basalt fibers, asphalt, asphalt concrete, and a composite comprising at least one material selected from the group consisting of sand, gravel, concrete, wood, glass, glass fibers, metal, carbon fibers, steel fibers, basalt fibers, asphalt and asphalt concrete, and a cross-section of said hollow defines a plurality of engagement structures in said hollow, at least one of said engagement structures extending along an entire length of said hollow and having a shape that, when engaged with a counterpart structure of a counterpart shape, inhibits disengagement of said counterpart structure from said engagement structure in a radial direction of said hollow.

13. The method of claim 12, comprising:

manufacturing said pile casing, wherein said manufacturing comprises:

driving a material through a die to produce an extruded product having a hollow that that extends through an entire length of said extruded product, said extruded product having a profiled inner surface and having a minimum thickness as measured between an exterior surface of said extruded product and said hollow of at least 3 cm, and sectioning said extruded product into a plurality of pile casings, each having a length of at least 2 m.

14. The method of claim 12, wherein said filling of said hollow is effected subsequent to a driving of said pile casing into the ground.

15. The method of claim 12, wherein:

said radial direction is an inward direction orthogonal to a longitudinal axis of said hollow.

16. The method of claim 12, wherein:

said at least one of said engagement structures has a T-shaped cross-section or a mushroom-shaped cross-section.

17. The method of claim 12, wherein:

said pile casing has a substantially rounded-rectangular cross-sectional outline.

* * * * *